US009839288B2

(12) United States Patent
Willach et al.

(10) Patent No.: US 9,839,288 B2
(45) Date of Patent: Dec. 12, 2017

(54) INCLINED SHELF CASE

(71) Applicant: Gebr. Willach GmbH, Ruppichteroth (DE)

(72) Inventors: Jens Willach, Eitorf (DE); Klaus-Dieter Schmidt, Numbrecht (DE)

(73) Assignee: Gebr. Willach GmbH, Ruppichteroth (DE)

( * ) Notice: Subject to any disclaimer, the term of this patent is extended or adjusted under 35 U.S.C. 154(b) by 0 days.

(21) Appl. No.: 15/310,573

(22) PCT Filed: May 8, 2015

(86) PCT No.: PCT/EP2015/060190
§ 371 (c)(1),
(2) Date: Nov. 11, 2016

(87) PCT Pub. No.: WO2015/173139
PCT Pub. Date: Nov. 19, 2015

(65) Prior Publication Data

US 2017/0079429 A1 Mar. 23, 2017

(30) Foreign Application Priority Data

May 14, 2014 (DE) ..... 10 2014 209 110

(51) Int. Cl.
*A47B 88/00* (2017.01)
*A47B 88/473* (2017.01)
(Continued)

(52) U.S. Cl.
CPC ..... *A47B 88/473* (2017.01); *A47B 88/483* (2017.01); *A47B 88/49* (2017.01);
(Continued)

(58) Field of Classification Search
CPC ..... A47B 88/473; A47B 88/00; A47B 88/57; A47B 88/90; A47B 88/49; A47B 88/483;
(Continued)

(56) References Cited

U.S. PATENT DOCUMENTS 4,749,242 A 6/1988 Rechberg
5,048,699 A * 9/1991 Trevaskis ..... A47B 57/14 211/128.1

(Continued)

FOREIGN PATENT DOCUMENTS

DE 8515351 U1 7/1985
EP 0555935 A1 8/1993
EP 0875187 A2 11/1998

*Primary Examiner* — Daniel J Rohrhoff
(74) *Attorney, Agent, or Firm* — The Webb Law Firm

(57) ABSTRACT

The invention relates to an inclined shelf case having a shelf body having at least one inclined shelf which drops away to the take-out side and has an abutting element holding a placed object on the bottom end thereof, wherein the at least one inclined shelf is held to the shelf body via guide rails and is designed as a pull-out running on the guide rails which can be pulled out to the take-out side and having a spring device for decelerating the inclined shelf during the pull-out, which operates between the shelf body and the inclined shelf. According to the invention the spring device has a connection element which has a first connection section, which is connected to the shelf body in an operating position by means of a holder , and which has a second connection section, and the inclined shelf has a fastening holder to which the connection element is fastened via the second connection section in an assembly position, wherein, upon pushing in the inclined shelf with the connection element in the assembly position, the first connection section engages on the holder and wherein the second connection section is removable from the fastening holder.

18 Claims, 5 Drawing Sheets

(51) Int. Cl.

| | |
|---|---|
| ***A47F 1/12*** | (2006.01) |
| ***A47F 3/06*** | (2006.01) |
| ***G07F 11/28*** | (2006.01) |
| ***G07F 11/32*** | (2006.01) |
| ***A47B 88/49*** | (2017.01) |
| ***A47B 88/483*** | (2017.01) |
| ***A47B 88/57*** | (2017.01) |
| ***A47B 95/02*** | (2006.01) |
| ***A47B 96/00*** | (2006.01) |

(52) U.S. Cl.
CPC ..... *A47B 88/57* (2017.01); *A47B 95/02* (2013.01); *A47B 96/00* (2013.01); *A47F 1/12* (2013.01); *A47F 3/063* (2013.01); *G07F 11/28* (2013.01); *G07F 11/32* (2013.01); *A47B 2095/024* (2013.01); *A47B 2210/0016* (2013.01); *A47B 2210/0059* (2013.01); *A47B 2210/0094* (2013.01)

(58) Field of Classification Search
CPC ... A47B 2210/0094; A47F 3/063; G07F 11/28
See application file for complete search history.

(56) References Cited

U.S. PATENT DOCUMENTS

| | | | | |
|---|---|---|---|---|
| 5,306,077 | A * | 4/1994 | Trevaskis | A47B 88/483 312/122 |
| 2003/0173876 | A1* | 9/2003 | Fujii | A47F 3/063 312/116 |
| 2003/0197453 | A1 | 10/2003 | Jurja | |
| 2006/0267465 | A1* | 11/2006 | Hung | G06F 1/183 312/273 |
| 2011/0100936 | A1* | 5/2011 | Chang | H05K 7/1489 211/26 |

* cited by examiner

INCLINED SHELF CASE

CROSS-REFERENCE TO RELATED APPLICATIONS

This application is the United States national phase of International Application No. PCT/EP2015/060190 filed May 8, 2015, and claims priority to German Patent Application No. 10 2014 209 110.1 filed May 14, 2014, the disclosures of which are hereby incorporated in their entirety by reference.

BACKGROUND OF THE INVENTION

Field of the Invention

The present invention relates to an inclined shelf case.

Description of Related Art

Inclined shelf cases serve to store and provide objects in sales rooms or storage rooms. They are particularly suited to receive rows of similar objects in a space-saving manner. It is a particular advantage that when the lowermost object is taken out, the remaining objects move down due to the effect of gravity so that there always is one object in the take-out position. An inclined shelf is advantageous over an arrangement of objects in vertical columns in that only a part of the weight of the other objects rests on the lowermost object and that the lowermost object is presented in a position for convenient removal so that taking out the same requires little effort. Inclined shelf cases are filled either from the rear side averted from the take-out side, or the inclined shelves are designed as pullouts adapted to be pulled out towards the take-out side.

In both cases it is possible to refill the shelves with new objects from the top so that the first-in-first-out principle can be carried out, according to which the goods that were stored first are also taken out first. Filling the inclined shelves from the rear is disadvantageous in that it requires additional depth of a room.

Inclined shelf cases are often used in pharmacies, where they are most often made of metal. With known inclined shelf cases in which the inclined shelves are designed as pullouts extractable towards the take-out side, these are supported at the shelf body via guide rails and can be pulled out until an end stop is reached that is integrated in the guide rails.

The inclined shelves have a great weight, in particular in the filled state and when they are made of metal, so that after a locking mechanism of the pushed-in inclined shelf is released, the same is highly accelerated due to the great weight and moves towards the open position at a high speed. This may cause injuries to the user or damage an end stop of the inclined shelf. Further, there is a risk that, when the shelf hits against the end stop, the goods accommodated on an inclined shelf fall out of the inclined shelf or become disarrayed as a result of the impulse.

For this reason, spring devices are often provided that act between the shelf body and the inclined shelf and brake the inclined shelf when being pulled out. The spring devices, which may be designed as rubber bands, for example, have sufficient spring force to brake a completely filled inclined shelf to such an extent that, when being pulled out, it moves against the end stop at a greatly reduced speed. However, as a consequence thereof, an inclined shelf filled only in part or not filled yet does not remain in a pulled out position when being pulled out, but is drawn back into a partly open position. This is disadvantageous especially when refilling such inclined shelves in which the objects are input at the end averted from the user.

Since the inclined shelves are mostly completely removable from the inclined shelf case for easier cleaning, the spring device must be detached from the shelf body or the inclined shelf prior to removal. However, when reinserting the inclined shelves, it is difficult to fasten the spring device to the shelf body or the inclined shelf in a manner that the functionality of the spring device is given. With known systems, the user often has to reach between the inclined shelves to fasten the spring device to the shelf body. In order to have more space for handling the spring device, this is done mostly in a partly open state of the inclined shelf, whereby, however, it is necessary to tension the spring more strongly, resulting in an increased effort when fastening the spring device.

Therefore it is an object of the present invention to develop an inclined shelf case of the type mentioned above such that the insertion of inclined shelves and the fastening of the spring device is simplified. Another, independent object of the present invention is to provide an inclined shelf case in which filling in objects is simplified, even with the spring device being active.

SUMMARY OF THE INVENTION

The invention provides an inclined shelf case having a shelf body with at least one inclined shelf which is inclined to the take-out side and has an abutting element at the bottom end thereof, holding objects placed thereon, wherein the at least one inclined shelf is supported at the shelf body via guide rails and is designed as a pullout running on the guide rails which can be pulled out to the take-out side. Further, a spring device is provided for decelerating the inclined shelf during being pulled out, said spring device acting between the shelf body and the inclined shelf. The inclined shelf case of the present invention is characterized in that the spring device has a connection element which has a first connection section, which is connected to the shelf body in an operating position by means of a holder, and which has a second connection section, and in that the inclined shelf has a fixation holder to which the connection element is fastened via the second connection section in an assembly position, wherein, upon pushing in the inclined shelf with the connection element in the assembly position, the first connection section engages the holder and wherein the second connection section is removable from the fixation holder.

In other words: For the purpose of assembling the inclined shelf to the shelf body, the connection element of the spring device is temporarily fastened to the inclined shelf, engages the holder on the shelf body when the inclined shelf is pushed in and is connected with the same in order to arrive at the operating position. By engaging the holder, the second connection section may be detached from the inclined shelf. This may be done already when pushing the inclined shelf in or only upon a subsequent pulling out of the inclined shelf in which the connection element is retained by the holder. Thereby, the spring device connects automatically with the shelf body when the inclined shelf is inserted and a troublesome manual connection by the user is thus avoided. The user merely has to fix, prior to the assembly of the inclined shelf, the connection element of the spring device to the fixation holder of the inclined shelf by means of the second connection section and can then insert the inclined shelf into the shelf body in a simple manner. The connection between the spring device and the holder at the shelf body is made as the inclined shelf is pushed in, without any further action of the user.

Detaching the second connection section from the fixation holder does not necessarily have to be effected immediately upon pushing in the inclined shelf. It may also be provided that, during assembly, the connection section is already connected with the holder immediately after the inclined shelf has been pushed in, while still engaging the fixation holder. In this case, a full detachment from the fixation holder may, for instance, be effected only upon the first opening procedure of the inclined shelf after assembly. In this embodiment the connection element will assume its final operating position only then.

The inclined shelf case of the present invention has the particular advantage that the spring device on the inclined shelf can be handled while the inclined shelf is arranged outside the shelf body so that ample space is available for handling the spring device. The assembly of the inclined shelves is thereby significantly simplified, e.g. after cleaning the inclined shelves. In particular, since the effort of tensioning the spring of the spring device to be made when fixing the connection element to the fixation holder is much lower with the inclined shelves of the present invention, fastening the spring device to the inclined shelf requires much less strength than required by conventional inclined shelf cases in which the spring device has to be fastened to the shelf body with the inclined shelf partly pulled out.

It is preferably provided that the first connection section engages behind the holder in the operating position. In this manner a particularly advantageous connection between the connection element and the holder becomes possible.

It is preferably provided that the holder has a sliding surface over which the first connection section slides into the operating position. It can thereby be guaranteed that the connection element reliably reaches the operating position after having engaged the holder, when the inclined shelf is pushed in, and after detachment from the fixation holder, and that the functionality of the spring device is ensured during the normal operation of the inclined shelf case.

It may be provided that the first connection section is hook-shaped or eyelet-shaped. In this manner, a connection between the first connection section of the connection element and the holder can be provided in a particularly advantageous manner by having the first connection section hooking behind the holder or by sliding the eyelet over the holder.

In a particularly preferred embodiment of the invention it is provided that the first connection section has an actuation surface which, as the inclined shelf is inserted, presses against the holder with the connection element in the assembly position and causes a pivoting of the connection element. The actuation surface may e.g. be an inclined surface. By pivoting the connection element, it is possible e.g. to initiate the process of detachment of the connection element from the fixation holder on the inclined shelf. In particular it can be achieved that the connection element is at least partly guided past the holder on order to engage behind the same for engagement therewith. This is advantageous in particular if the first connection section is of a hook-shaped or eyelet-shaped design. Thus, the actuation surface causes the connection element to be pivoted by the holder as the inclined shelf is pushed in, so that the connection element can engage the holder on the shelf body.

It is preferably provided that the holder is designed as a fastening hook. Thereby, the connection element can be connected with the holder in an advantageous manner. It is preferably provided that the holder in the form of a fastening hook protrudes from the shelf body in the direction of the inclined shelf. Thereby, the fastening hook may advantageously press against the actuation surface of the connection element. Further, by making the fastening hook protrude in the direction of the inclined shelf, it may be achieved that the sliding surface, over which the first connection section slides into the operating position, can be formed in an advantageous manner.

The connection element may be made of plastic material, for instance. Thus, the connection element can be manufactured in a simple manner, e.g. by a casting process.

It is preferably provided that the second connection section is of a hook-shaped design. Thereby, the connection element can be connected with the inclined shelf in a simple manner in the assembly position, wherein the connection element can be detached in a simple manner by unhooking the second connection section from the fixation holder. Further, the hook-shaped design of the second connection section makes it possible to achieve in a simple manner that the detachment of the second connection section can be effected at least in part by pivoting the connection element.

The inclined shelf may in particular be designed as a pullout tray with side walls and a front wall forming the abutment element.

In this regard it may be provided that the fixation holder is arranged on one of the side walls at the end averted from the take-out side. It is thus achieved that the connection element can be fixed on the side remote from the take-out side so that, when pushing in the inclined shelf, it gets into the inner portion of the shelf body and can be connected with the holder arranged there. The spring device of the present invention may thus be arranged in a manner similar to the known spring device, wherein, however, the assembly of the spring device of the inclined shelf case of the present invention is significantly simplified.

It is preferably provided that the fixation holder comprises a plate section with a side edge onto which the hook-shaped second connection section can be pushed. The plate section may e.g. be formed by an end section of the side wall. In this manner the fixation holder can be provided in a structurally simple manner, wherein the connection element is fixed in an advantageous manner to the fixation holder by means of a hook-shaped connection section and can assume a stable assembly position.

The fixation holder may further have a cutout into which the second connection section may be hooked, e.g. clipped. This may also be formed by a corresponding cutout in the plate section. By providing a cutout in the fixation holder it can be achieved that the second connection section can assume a stable assembly position in a particularly advantageous manner, whereby it is achieved that the connection element does not slip prematurely out of the assembly position as the inclined shelf is pushed in, so that connection of the guiding element with the holder can be achieved in a reliable manner.

It may also be provided that the fixation holder comprises an inclined section over which the second connection section can slide while being set thereon. It can thereby be achieved that, even if the connection element is inaccurately fixed on the fixation holder, the former is moved into the assembly position and, thereby, a reliable functionality of the connection element can be achieved when the inclined shelf is pushed in.

In a preferred embodiment of the invention it is provided that a first end of the spring element is fastened to a spring holder on the inclined shelf, and that the connection element is fastened to a second end of the spring device. The fastening of the connection element to the spring device may be provided to be detachable, e.g. via a spring hook. It may thereby be achieved that the spring device and/or the connection element can be replaced in a simple manner without having to replace the respective other element at the same time.

In this regard it may be provided that the distance between the spring holder and the fixation holder in the depth direction of the inclined shelf is greater than the length of the spring device in the relaxed state. In other words: While the connection element is arranged in the assembly position, the spring device is slightly tensioned. It can thereby achieved in a simple manner that the connection element is fixed to the fixation holder via the second connection section, since the connection element can be held in the assembly position by the spring force of the spring device in the slightly tensioned state.

It is preferably provided that the distance in the width direction of the inclined shelf between the side wall of the inclined shelf and the intersection of the centre axis of the spring and the connection element, in the operating position of the connection element, is at least 0.75 times the spring diameter of a spring of the spring holder.

Especially when coil springs are used there is a problem that, in a slightly tensioned state, these tend to hit against a side wall of the inclined shelf when the inclined shelf is moved, whereby noise is generated. This risk is reduced by making the minimum distance between the side wall and the region of the connection element at which the spring device engages in the operating position at least 0.75 times the spring diameter. In other words: Sufficient free space is created and the spring can extend obliquely outward from the spring holder along the side wall towards the holder. This significantly reduces the risk of the spring hitting against the side walls of the inclined shelf when the inclined shelf is moved.

In the inclined shelf case of the present invention it may also be provided that two spring devices each having a connection element are provided, which are arranged on the right and the left side of the inclined shelf. In this embodiment, the inclined shelf case of the present invention thus has two holders on the shelf body and the inclined shelf also has two fixation holders.

In a particularly preferred embodiment of the invention a movable stop element is provided that, in an open position of the inclined shelf, can be moved from a rest position into a stop position, wherein a stop is provided that is arranged on the shelf body or on the inclined shelf, the stop element cooperating with said stop. This aspect of the invention also is of independent importance and may thus be realized independent of the design of the spring device with the connection element, the fixation holder and the holder on the shelf body.

The movable stop element and the stop cooperating with said stop element make it possible that, in an open position, the inclined shelf is kept open by means of the stop element and the stop and is not pulled back by the spring device. Thereby, loading the inclined shelf is simplified. Owing to the fact that the stop element is movable, the same can be moved out of the stop position in a simple manner to detach the stop element from the stop, so as to enable the closing of the inclined shelf. Further, in one embodiment of the invention it may be provided that the stop element acts selectively. In other words: It may be provided that the stop element is moved, and can thus cooperate with the stop, only in special situations, e.g. if so desired by the user. The stop position of the stop element is the position in which the stop element can cooperate with the stop, i.e. in which the stop and the stop element are in alignment with each other.

Due to the fact that the inclined shelf is maintained in the open position, filling the inclined shelf with objects can be done in a particularly advantageous manner, since the user does not have to use a hand to keep the inclined shelf open, so that e can fill the inclined shelf with both hands and thus particularly fast.

It is preferably preferred that the stop element is arranged on the inclined shelf and the stop is arranged on the shelf body.

The stop element can be moved into the stop position either by the effect of gravity or by user operation.

It is preferably provided that the stop or the stop element has a protrusion that prevents a return movement of the stop element in the state abutting on the stop. In other words: when the stop element is arranged in the stop position and abuts on the stop, the protrusion prevents the stop element from returning into the rest position. It is thereby prevented that the stop element in the state resting against the stop becomes detached from the same, whereby the inclined shelf is unintentionally moved from the open position towards the closed position due to the spring force of the spring device.

An unintentional movement of the inclined shelf from the open position towards the closed position may present a risk of injury to the user in particular when filling is done with both hands. Therefore, it is of particular advantage if it is ensured that the stop element does not unintentionally move from the stop position into the rest position.

It is preferably provided that a spring element pre-tensions the stop element towards the rest position. In other words: The stop element can be moved into the stop position only against a spring force. When the stop element rests on the stop, the stop element remains in the stop position, e.g. due to the protrusion provided on the stop in front of the stop element. It is achieved by the spring element that, in case of an intentional detaching of the stop element from the stop, the stop element is moved into the rest position without any further action. For this reason, the operation of the stop element of the present invention is particularly advantageous.

In this regard it may be provided that the spring element urges the stop element against a rest position stop, when the stop element is in the rest position. In other words: When the stop element is in the rest position, the spring element further exerts a spring force on the stop element. Thereby it is achieved that the stop element can be moved out of the rest position only against the spring force of the spring element. When pulling out and pushing in the inclined shelf it is thus prevented that each stop element is moved in an uncontrolled manner and e.g. hits against a side wall of the inclined shelf. In this manner, the generation of undesired noise is avoided. An actuation element for the stop element may be arranged on a handlebar or the side wall of the inclined shelf. Thus, the stop element may advantageously be operated from the side of the inclined shelf facing the user.

It is preferably provided that the actuation element is connected with the stop element via a pivotable rod. Thereby, the desired movement of the stop element can be transmitted over a longer distance e.g. from the handlebar or the side wall to a rear portion of the inclined shelf. The rod may for instance be rotatably supported in the side wall of the inclined shelf.

In one embodiment of the invention it may be provided that two stops and two stop elements are provided, wherein one stop element or stop is arranged on the right and on the left side of the inclined shelf, respectively. Thereby, it is prevented that, in case of two spring devices acting between the inclined shelf and the shelf body, the inclined shelf becomes tilted or warped easily. Providing two spring devices and only one stop element would result in the spring force of one spring device being absorbed by the stop element and the stop, whereas the spring force on the other side would still pull the inclined shelf in the direction of the closed position. This could cause undesired tilting or warping of the inclined shelf.

BRIEF DESCRIPTION OF THE DRAWINGS

It may be provided that the two stop elements each have one actuation element. Likewise, a common actuation element for both stop elements may be provided.

The following is a detailed explanation of the invention with reference to the following drawings.

In the Figures:

Figure 1:
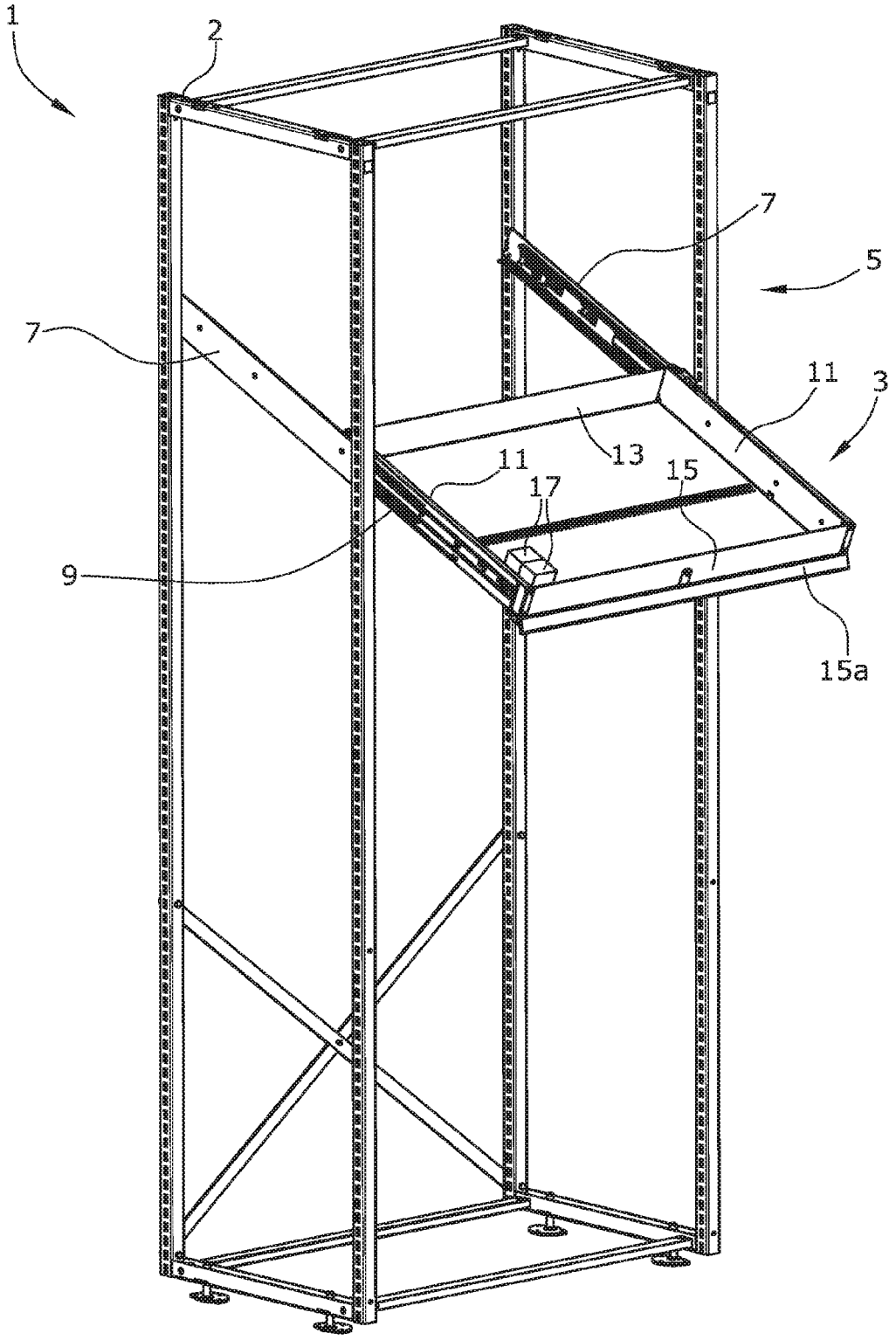
Figure 2A:
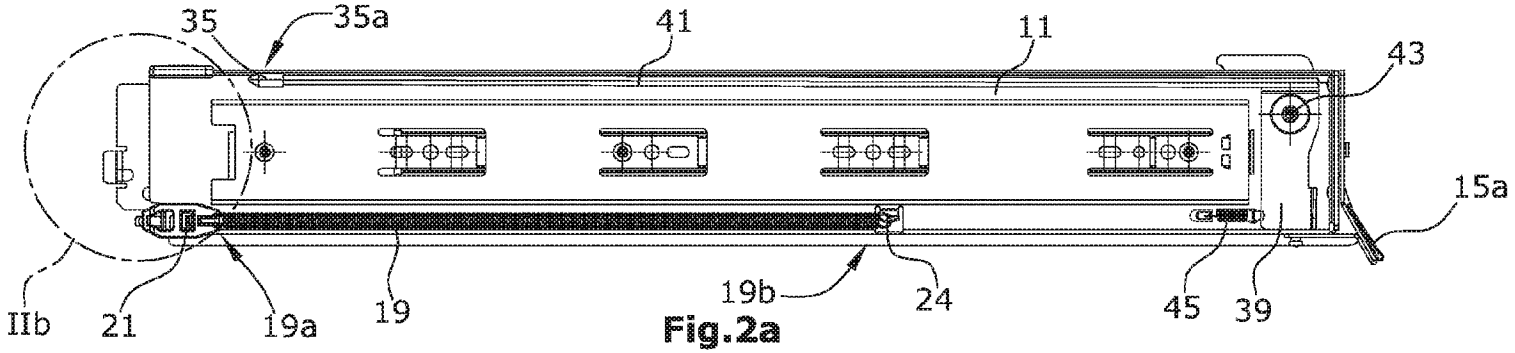
Figure 2B:
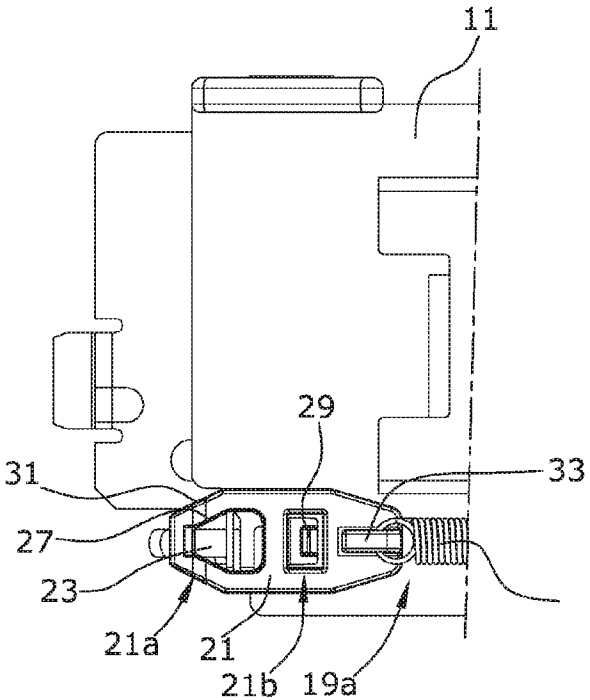
Figure 3:
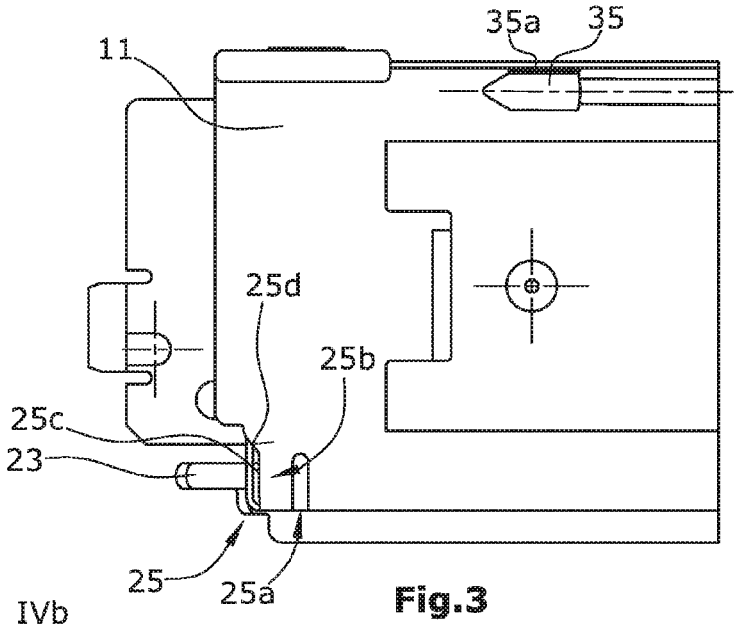
Figure 4A:
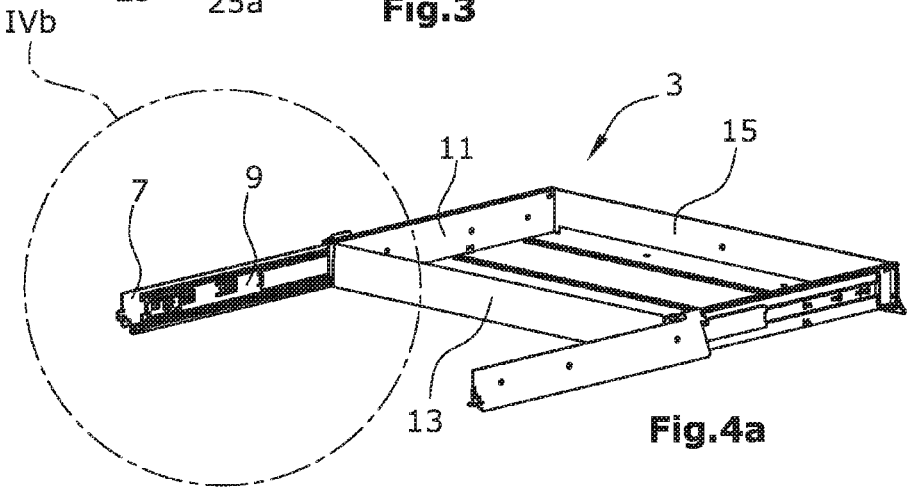
Figure 4B:
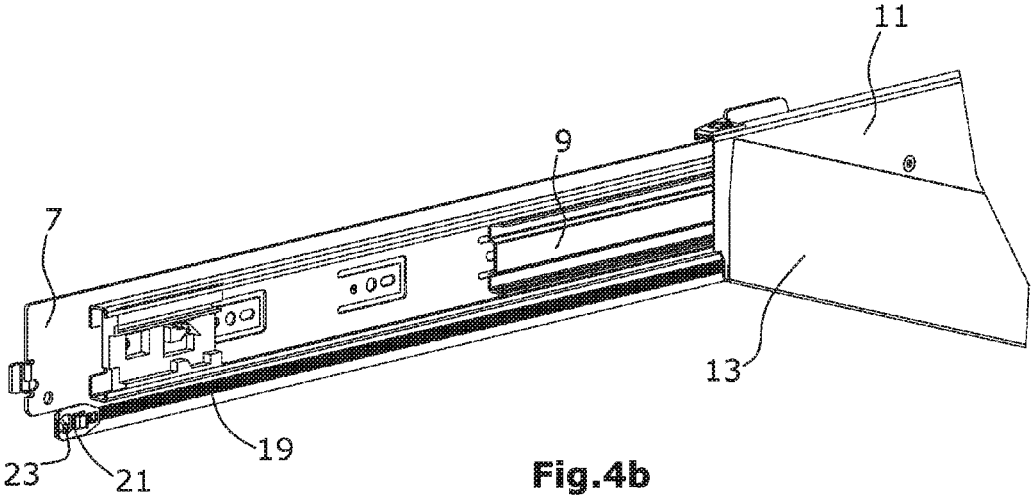
Figure 5A:
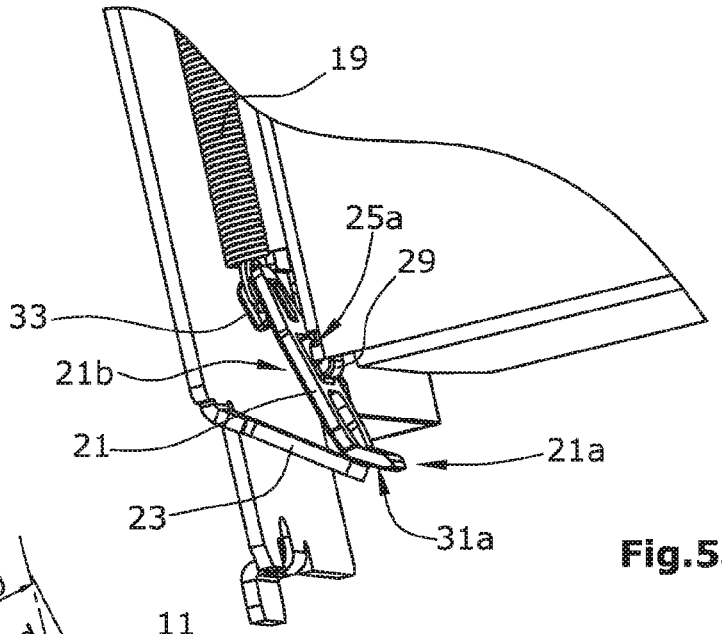
Figure 5B:
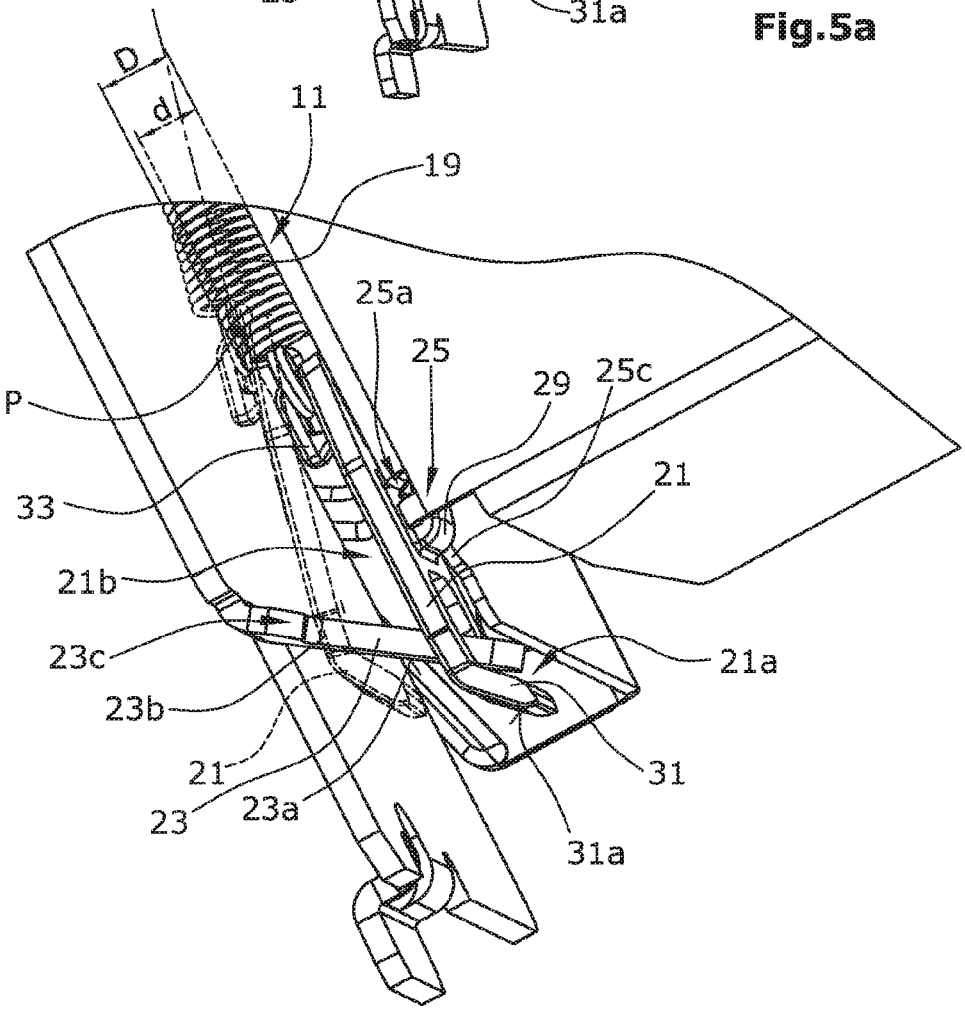
Figure 6A:
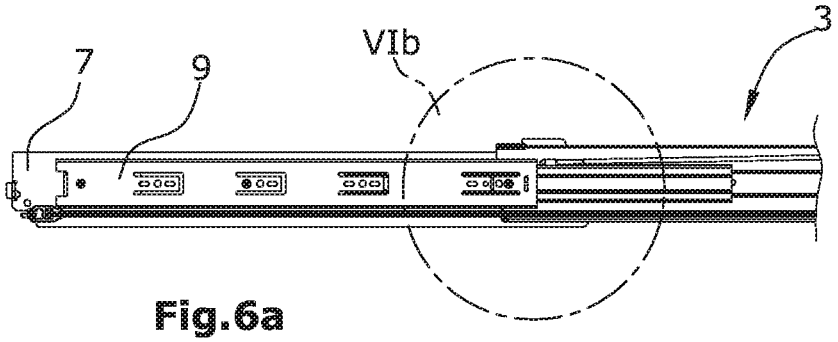
Figure 6B:
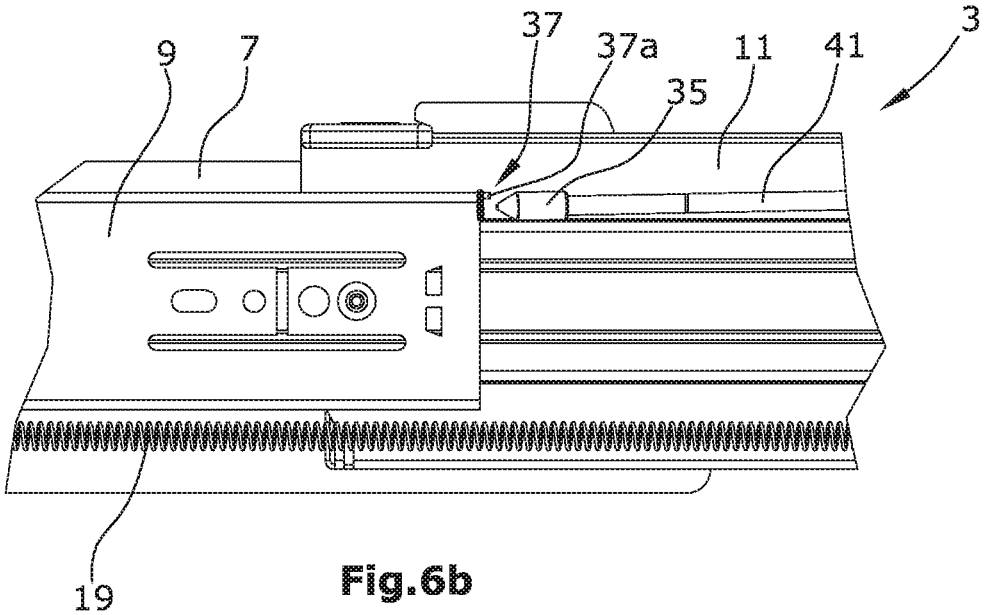

FIG. 1 is a schematic perspective view of an inclined shelf case of the present invention with an inclined shelf in the open state, FIGS. 2*a* and 2*b* are schematic side views of the inclined shelf with the connection element in the assembly position, FIG. 3 is a schematic illustration of the fixation holder on the inclined shelf, FIGS. 4*a* and 4*b* are schematic details of the inclined shelf with a spring device with a connection element in the operating position, FIGS. 5*a* and 5*b* are schematic details of the inclined shelf upon engagement of the connection element at the holder on the shelf body, and FIGS. 6*a* and 6*b* are details of the inclined shelf with the stop element in the stop position.

DESCRIPTION OF THE INVENTION

FIG. 1 schematically illustrates the inclined shelf case 1 of the present invention in a perspective view. The inclined shelf case 1 comprises a shelf body 2 at which an inclined shelf 3 is arranged. Generally, a plurality of inclined shelves 3 are arranged one below the other in such an inclined shelf case 1; however, FIG. 1 only shows a single inclined shelf 3 for reasons of clarity.

The inclined shelf 3 is inclined towards the take-out side 5 of the inclined shelf case 1. The inclined shelf 3 is supported at the shelf body 2 via supports 7. The inclined shelf 3 is designed as a pullout adapted to be pulled out to the take-out side 5 and is guided in guide rails 9. The guide rails 9 are designed as telescopic rails and are fastened to the supports 7.

The inclined shelf 3 is designed as a pullout tray and has side walls 11, a rear wall 13 as well as a front wall 15. The front wall 15 forms an abutment element for objects 17 placed in the inclined shelf 3.

A handlebar 15*a* is arranged at the bottom side of the front side 15, by means of which the inclined shelf 3 can be grasped in an advantageous manner to be pulled to an open position illustrated in FIG. 1.

Due to the inclined shelf being inclined towards the take-out side 5, the objects 17 received in the inclined shelf 3 can be arranged in a row, and upon removal of the object 17 abutting against the front wall 15, the other objects 17 slide down under the effect of gravity. For this purpose the objects 17 are most often arranged in rows.

In order to allow a first-in-first out principle, objects 17 are most often filled in from the end of a row of objects 17 that faces the rear wall 13. In order to allow a refilling that is as comfortable as possible, the inclined shelf 3 has to be moved into an open position in which the inclined shelf 3 is almost fully pulled out. A corresponding position is illustrated in FIG. 1.

The inclined shelves 3 may for instance be made of metal. Due to the dead weight of the inclined shelf 3 and the objects 17 arranged in the inclined shelf 3, the inclined shelf 3 moves from a closed position to an open position without any action by a user. Therefore, the inclined shelf 3 has a locking mechanism which is not illustrated in the Figures and by which the inclined shelf can be maintained in the closed position. Pulling out is possible only after unlocking the locking mechanism.

However, due to the great weight of the inclined shelf 3 and the objects 17 placed therein, there is a risk that, after unlocking the locking mechanism, the inclined shelf reaches a high speed and moves into the open position at this high speed. This represents a risk of injury to the user and, moreover, there is a risk that non-illustrated end stops for the inclined shelf 3 are damaged.

The inclined shelf case 1 thus comprises spring devices 19 that decelerate the inclined shelf 3 during pull out and act between the shelf body 2 and the inclined shelf 3.

The embodiment illustrated in the Figures comprises two spring devices 19, wherein one spring device 19 is arranged on the right and the left side of the inclined shelf 3, respectively. In an operating position in which the spring devices 19 can cause a deceleration of the inclined shelf, the spring devices are each connected with a holder 23 on the shelf body 2 via a connection element 21 fastened to the first end 19*a* of the spring device 19. As can be seen in FIG. 4*b* and FIG. 5*b*, the holder 23 is designed as a fastening hook protruding from the support 7 towards the inclined shelf 3.

At a second end 19*b*, the spring devices 19 are each fastened to a spring holder 24 arranged on the side wall 11 of the inclined shelf 3.

The connection element 21 illustrated in detail in FIG. 2*b* comprises a first connection section 21*a* by which the connection element 21 is connected with the holder 23 when in the operating position. Further, the connection element 21 has a second connection section 21*b* by which the connection element 21 can be fastened to a fixation holder 25.

In the embodiments illustrated in the Figures, the first connection section 21*a* of the connection element 21 has an eyelet 27 with which the connection element 21 engages behind the holder 23 by the holder 23 partly engaging through the eyelet 27.

The second connection section 21*b* comprises a hook 29 which may be hooked into the fixation holder 25. For this purpose, the fixation holder 25 has a cutout 25*a* as well as a plate section 25*b* formed by the side wall 11. To fix the connection element 21 to the fixation holder 25, the hook 29 of the second connection section 21*b* is slipped over a side edge 25*c* of the plate section 25*b* and hooks into the cutout 25*a*. Thus, a clip connection is formed.

When an inclined shelf 3 is taken out of the shelf body 2, e.g. for cleaning purposes, the spring device 19 has to be hooked out of the holder 23. This is done by the user reaching into the shelf body 2, while the inclined shelf is pulled out, and detaching the connection element 21 from the holder 23.

If the inclined shelf 3 is to be inserted into the shelf body 2 again, the present invention allows a temporary fixation of the connection element 21 at the fixation holder 25 of the inclined shelf 3. In this position the connection element 21 is in its assembly position. By means of an inclined surface 25*d* it is achieved that, even if the connection element 21 is inaccurately arranged in the fixation holder 25, the former still slides into the assembly position. The connection element 21 is maintained in the assembly position by the spring force of the spring device 19. This is achieved by making the distance between the fixation holder 25 and the spring holder 24 greater than the length of the spring device 19 in the relaxed state. In other words: when the connection element 21 is arranged in the assembly position, the spring device 19 is in a slightly tensioned state. By means of a clip connection at the fixation holder it is ensured that the connection element is not inadvertently pushed out of the assembly position.

Upon assembly of an inclined shelf 3 into the shelf body, the inclined shelf 3 is first set into the guide rails 9 and can be pushed in, wherein the connection element 21 in the assembly position is moved along with the inclined shelf 3. Shortly before reaching the closed position of the inclined shelf 3, the connection element 21 abuts against the holder 23. The first connection section 21*a* has an angled portion 31 having an actuation surface 31*a* extending obliquely with respect to the rest of the connection element 21. The connection element 21 abuts against the holder 23 by means of the actuation surface 31*a*, whereby a pivoting of the connection element 21 is caused. In FIG. 5*a* the connection element 21 is shown in a slightly pivoted position. By pivoting the connection element 21 the first connection section 21*a* of the connection element 21 can be guided past the holder 23 so that the holder 23 can engage into the eyelet 27. By the connection element hooking into the holder 23, the connection element 21 is retained at the holder 23. When the inclined shelf 3 is pulled out again, the connection element 21 becomes detached from the fixation holder 25 and, due to a slide surface 23*a* on the holder 23, the connection element 23 slides into its final operating position.

Due to the connection element of the present invention it becomes possible to connect the spring device 19 with the holder 23 without any further action by the user, since the connection element 21 automatically hooks to the holder 23. Thereby, inserting the inclined shelves 3 into the shelf body 2 is significantly simplified.

The spring device 19 is designed as a coil spring, for instance. To fasten the spring device 19 to the connection element 21, the connection element 21 comprises e.g. a spring hook 33 into which the spring device 19 can be hooked.

In the operating position illustrated in broken lines in FIG. 5*b*, the connection element 21 shows a lateral distance to the inclined shelf 3.

In the operating position the connection element 21 is situated in an engagement portion 23*b* of the holder 23 and rests laterally on a stop 23*c*. In the operating position the intersection P of the centre axis of the spring of the spring device 19 and the connection element 21 shows a distance d in the width direction of the inclined shelf 3 to the side wall 11, which is at least 0.75 times the spring diameter D of the spring of the spring device 19.

Due to the distance d in the width direction of the inclined shelf 3 between the side wall and the intersection P at the connection element 21, it is achieved that ample space is created and that, in the operating position, the spring device 19 can be guided away from the inclined shelf 3 in an oblique lateral direction. Thus, it is avoided that in case of a slight vibration of the spring device 19 as the inclined shelf 3 is pulled out or pushed in, the spring device 19 hits against the side wall 11, whereby an undesired generation of noise is caused.

The connection element 21 is made e.g. of plastic material. This has the advantage that the connection element 21 can slide advantageously along the holder made of metal.

The spring device 19 has a relatively great spring force, since the inclined shelf 3 has to be reliably decelerated by the spring device 19 also in an entirely filled state. As a consequence, an inclined shelf 3 in the empty state does not have enough weight to remain in an open position, but the spring device 19 will pull the inclined shelf 3 towards the closed position. This is unfavorable when the inclined shelf 3 is to be filled, since the user has to use one hand to hold the inclined shelf 3. Therefore, the present invention provides a movable stop element 35 cooperating with a stop 37. The stop element 35 and the stop 37 are illustrated in detail in FIGS. 6*a* and 6*b*. In the embodiment illustrated, the stop 37 is formed by the guide rail 9. Using an actuation device 39 connected with the stop element 35 via a rod 41, the stop element can be moved from a rest position illustrated in FIG. 2*a* into a stop position illustrated in FIG. 6*b*. When the user now fully extracts the inclined shelf 3, he can move the stop element 35 into the stop position by means of the actuation element 39. Due to the spring force of the spring device 19, the inclined shelf 3 is guided rearward over a short distance in the direction of the closed position and the stop element 35 comes to rest on the stop 37. Thus, the inclined shelf 3 is maintained in the open position now assumed.

The stop 37 comprises a protrusion 37*a* which is engaged behind by the stop element 35, whereby the protrusion prevents a rearward movement of the stop element 35 when in the state resting on the stop. If the user now desires to push in the inclined shelf 3, he first has to pull the inclined shelf 3 slightly in the opening direction so that the stop element 35 can be guided past the protrusion 37 and be moved into the rest position. The inclined shelf 3 can then be shifted into the closed position.

The rod 41 is rotatable supported in the side wall 11 by means of a rotary bearing 43. Further, a spring element 45 engages the actuation element 39, which pre-tensions the stop element 35 in the direction of the rest position. On the one hand, it is thereby achieved that the stop element 35 automatically returns into the rest position when being detached from the stop 37 and, on the other hand, the stop element 35 is pressed against a rest position stop 35*a* on the side wall 11 of the inclined shelf 3. Thus, when the inclined shelf 3 is moved, a movement of the stop element 35 is largely prevented, whereby the generation of noise is avoided.

The stop element 35 tapers to a point in the direction of the stop 37, whereby it is achieved that the stop 37 advantageously engages behind the protrusion 37*a* of the stop 37.

In the inclined shelf case 1, a respective stop element 35 with the associated stop 37 may be provided on both the right and the left side of an inclined shelf. Preferably, a side of an inclined shelf 3 on which a spring device 19 is arranged is also provided with a stop element 35 and a stop 37.

The invention claimed is:

1. An inclined shelf case comprising a shelf body with at least one inclined shelf which is inclined to the take-out side and has an abutting element at the bottom end thereof, holding objects placed thereon, wherein the at least one inclined shelf is supported at the shelf body via guide rails and is designed as a pullout running on the guide rails which can be pulled out to the take-out side and has a spring device for decelerating the inclined shelf while being pulled out, said spring device acting between the shelf body and the inclined shelf, wherein the spring device has a connection element which has a first connection section, which is connected to the shelf body in an operating position by means of a holder, and which has a second connection section, and the inclined shelf has a fixation holder to which the connection element is fastened via the second connection section in an assembly position, wherein, upon pushing in the inclined shelf with the connection element in the assembly position, the first connection section engages the holder and wherein the second connection section is removable from the fixation holder.

2. The inclined shelf case of claim 1, wherein the first connection section engages behind the holder in the operating position.

3. The inclined shelf case of claim 1, wherein the holder has a sliding surface over which the first connection section slides into the operating position.

4. The inclined shelf case of claim 1, wherein the first connection section is hook-shaped or eyelet-shaped or the first connection section has an actuation surface which, as the inclined shelf is inserted, presses against the holder with the connection element in the assembly position and causes a pivoting of the connection element.

5. The inclined shelf case of claim 1, wherein the holder is designed as a fastening hook or the second connection section is of a hook-shaped design.

6. The inclined shelf case of claim 5, wherein the fixation holder comprises a plate section with a side edge onto which the hook-shaped second connection section can be pushed or the fixation holder has a cutout in-to which the second connection section can be hooked.

7. The inclined shelf case of claim 5, wherein the fixation holder comprises a plate section with a side edge onto which the hook-shaped second connection section can be pushed and the fixation holder has a cutout in-to which the second connection section can be hooked.

8. The inclined shelf case of claim 1, wherein the inclined shelf is designed as a pullout tray with side walls and a front wall forming the abutment element, the fixation holder being arranged on one of the side walls at the end averted from the take-out side.

9. The inclined shelf case of claim 1, wherein the connection element is fastened to a first end of the spring device, and in that the spring device is fastened by a second end to a spring holder on the inclined shelf.

10. The inclined shelf case of claim 9, wherein the distance between the spring holder and the fixation holder in the depth direction of the inclined shelf is greater than the length of the spring device in the relaxed state.

11. The inclined shelf case of claim 1, wherein the distance in the width direction of the inclined shelf between the side wall and an intersection of the centre axis of the spring device and the connection element, in the operating position of the connection element, is at least 0.75 times the spring diameter of a spring of the spring device.

12. The inclined shelf case according to claim 1, further comprising a movable stop element that, in an open position of the inclined shelf, can be moved from a rest position into a stop position, and by a stop that is arranged on the shelf body or on the inclined shelf, the stop element cooperating with said stop.

13. The inclined shelf case of claim 12, wherein the stop or the stop element has a protrusion that prevents a return movement of the stop element in the state abutting on the stop.

14. The inclined shelf case of claim 12, wherein a, spring element pre-tensions the stop element towards the rest position, the spring element urging the stop element against a rest position stop, when the stop element is in the rest position.

15. The inclined shelf case of claim 12, wherein an actuation element for the stop element is arranged on a handlebar or the side wall of the inclined shelf.

16. The inclined shelf case of claim 15, wherein the actuation element is connected with the stop element via a pivotable rod.

17. The inclined shelf case of claim 1, wherein the first connection section is hook-shaped or eyelet-shaped and the first connection section has an actuation surface which, as the inclined shelf is inserted, presses against the holder with the connection element in the assembly position and causes a pivoting of the connection element.

18. The inclined shelf case of claim 1, wherein the holder is designed as a fastening hook and the second connection section is of a hook-shaped design.

* * * * *